US005827796A

United States Patent [19]

Iwakura et al.

[11] Patent Number: 5,827,796

[45] Date of Patent: Oct. 27, 1998

[54] THERMAL RECORDING MATERIAL

[75] Inventors: Ken Iwakura, Kanagawa; Takekatsu Sugiyama, Shizuoka; Masato Satomura, Kanagawa; Akira Igarashi, Shizuoka, all of Japan

[73] Assignee: Fuji Photo Film Co., Ltd., Kanagawa, Japan

[21] Appl. No.: 771,074

[22] Filed: Aug. 30, 1985

[51] Int. Cl.[6] ..... B41M 5/30

[52] U.S. Cl. ..... 503/209; 503/208

[58] Field of Search ..... 346/208, 209; 503/208, 209

[56] References Cited

U.S. PATENT DOCUMENTS

| | | | |
|---|---|---|---|
| 4,531,140 | 7/1985 | Suzuki et al. | 346/209 |
| 4,539,578 | 9/1985 | Igarashi et al. | 346/208 |

FOREIGN PATENT DOCUMENTS

| | | | |
|---|---|---|---|
| 0014094 | 1/1982 | Japan | 346/209 |
| 0071191 | 4/1983 | Japan | 346/208 |

*Primary Examiner*—Bruce H. Hess
*Attorney, Agent, or Firm*—Sughrue, Mion, Zinn, Macpeak & Seas, PLLC

[57] ABSTRACT

A thermal recording material comprising a support having thereon at least one layer containing an electron donating colorless dye, an electron accepting compound and a diaryloxyalkane derivative represented by the following general formulae (I) to (III)

$$Ar^1O\ (CH_2)_nOAr^2 \quad (I)$$

$$Ar^2O—W—OAr^3 \quad (II)$$

$$Ar^2OR—X—ROAr^3 \quad (III)$$

wherein $Ar^1$ represents an aryl group having at least one substituent selected from the group consisting of an alkoxyl group containing 2 or more carbon atoms, an alkoxycarbonyl group containing 3 or more carbon atoms, an aryloxyl group, an aryloxycarbonyl group, an alkenyl group containing 2 or more carbon atoms, an aryl group containing 4 or more carbon atoms an acyloxyl group containing 2 or more carbon atoms, a fulorine atom, a bromine atom, a carboxyl group, an alkylenedioxy group, a cycloalkyl group and a hydroxyl group; $Ar^2$ and $Ar^3$ each represents a substituted or unsubstituted aryl group the substituent thereof being selected from the group consisting of an alkyl group, an alkenyl group a cycloalkyl group, a cycloaklenyl group, a halogen atom, an acyl group, an acyloxyl group, an alkoxyl group, a thioalkoxyl group, a alkoxycarbonyl group, an aryloxycarbonyl group, an aryloxyl group, a cyano group, a hydroxyl group, a carboxyl group, an aryl group, an alkylenedioxy group and an aralkyl group and $Ar^2$ and $Ar^3$ are the same or different; R represents a divalent group containing from 1 to 6 carbon atoms; X represents —S—, —$OCH_2O$—,

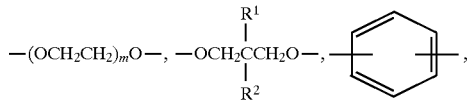

or

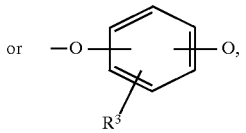

(wherein $R^1$ and $R^2$ each represents a hydrogen atom, a halogen atom, a hydroxyl group, an alkoxyl group, an acyloxyl group or a lower alkyl group and $R^1$ and $R^2$ are the same or different; $R^3$ represents a hydrogen atom, a lower alkyl group, a lower alkoxyl group or a halogen atom; and m is an integer of 1 or 2) W represents a branched alkylene group, and n is an integer of from 1 to 10.

5 Claims, No Drawings

THERMAL RECORDING MATERIAL

BACKGROUND OF THE INVENTION

The present invention relates to a thermal recording material. More particularly, the invention relates to a thermal recording material having improved color developing property.

Thermal recording materials using an electron donating colorless dye and an electron accepting compound are disclosed in Japanese Patent Publication Nos. 14039/1970 and 4160/1968. The minimum requirements that should be met by such thermal recording materials are (1) provision of adequate color density and sensitivity, (2) absence of fog (i.e., no color formation during storage of the material before use), and (3) the formation of a satisfactorily fast color image. No single thermal recording material available today completely satisfys all of these requirements.

With the increasing demand for higher-speed operation of thermal recording systems, considerable effort is being made to develop materials that meet requirement (1).

One approach is to adjust the melting point of an electron accepting compound to be within the range of 60° C. to 100° C. However, it is difficult to control the melting points of phenolic compounds which are most commonly used as electron accepting compounds. Even if such adjustment is realized, the resulting phenolic compounds are too expensive to be used for practical purposes.

Another approach is described in Japanese Patent Publication Nos. 17748/1974 and 39567/1976, and depends on either using both an organic acid and a phenolic compound as electron accepting substances or using a polyvalent metal salt of a compound having an alcoholic hydroxyl group. Japanese Patent Publication No. 29945/1976 discloses the use of a copolymer of hydroxyethyl cellulose and a salt of maleic anhydride.

The addition of waxes is described in Japanese Patent Publication No. 27599/1976 and Japanese Patent Application (OPI) No. 19231/1973 (the term "OPI" as used herein referring to a "published unexamined Japanese patent application").

Other approaches are described in Japanese Patent Application (OPI) Nos. 34842/1974, 115554/1974, 149353/1975, 106746/1977, 5636/1978, 11036/1978, 48751/1978 and 72996/1981; including the use of sensitizers such as nitrogen-containing organic compounds (e.g., thioacetanilide, phthalonitrile, acetamide, di-β-naphthyl-p-phenylenediamine, fatty acid amides, acetoacetanilide, diphenylamine, benzamide and carbazole), heat-fusible substances (e.g., 2,3-di-m-tolylbutane and 4,4'-dimethylbiphenyl), and carboxylic acid esters (e.g., dimethyl isophthalate, diphenyl phthalate and dimethyl terephthalate). British Patent Application No. 2,074,335A discloses the addition of hindered phenols.

However, the thermal recording materials prepared by using these prior art techniques are not completely satisfactory in terms of color density and sensitivity.

Inventors have investigated various kinds of aromatic ethers, and have found that in the aromatic ethers, phenyl phenoxyacetate, diphenoxyethane, etc., are especially superior in sensitization effect. The aromatic ethers, however, have some disadvantages. For example, the sensitizer such as a phenyl phenoxyacetate, which has an ester moiety derived from phenol, is inferior in a stability with the elapse of time. Further, in a case of sensitizer comprising diether such as a diphenoxyethane, which has a symmetrical structure, the coated layer containing the diether is insufficient in stability with the elapse of time.

SUMMARY OF THE INVENTION

One object, therefor, of the present invention is to provide a thermal recording material that exhibits satisfactorily high color density and sensitivity without sacrificing any other performance requirements.

Accordingly, the present invention has now been accomplished by a thermal recording material comprising a support having thereon at least one layer containing a diaryloxyalkane derivative, and to a thermal recording composition containing an electron donating colorless dye, an electron accepting compound, and a diaryloxyalkane derivative.

DETAILED DESCRIPTION OF THE INVENTION

The diaryloxyalkane derivative used according to the present invention is preferably selected from among the compounds represented by formulae (I), (II) and (III)

$$Ar^1—O(CH_2)_nOAr^2 \quad (I)$$

$$Ar^2O—W—OAr^3 \quad (II)$$

$$Ar^2OR—X—RoAr^3 \quad (III)$$

wherein, $Ar^1$ represents an aryl group having at least one substituent selected from the group consisting of an alkoxyl group containing 2 or more carbon atoms, an alkoxycarbonyl group containing 3 or more carbon atoms, an aryloxylgroup, an aryloxy carbonyl group, an alkyenyl group having 2 or more carbon atoms, an acyl group containing 4 or more carbon atoms, an acyloxy group containing 2 or more carbon atoms, a fluorine atom, a bromine atom, a carboxyl group, an alkylenedioxy group, a cycloalkyl group and a hydroxyl group, $Ar^2$ and $Ar^3$ each represents a substituted or unsubstituted aryl group, the substituent thereof being selected from the consisting of an alkyl group, an alkenyl group, a cycloalkyl group, a cycloalkenyl group, a halogen atom, an acyl group, an acyloxyl group, an alkoxyl group, a thioalkoxyl group, an alkoxycarbonyl group, an aryloxycarbonyl group, an aryloxyl group, a cyano group, a hydroxyl group, a carboxyl group, aryl group, an alkylenedioxy group, and an aralkyl group, and $Ar^2$ and $Ar^3$ in the general formulae (II) and (III) are the same or different; R represents a divalent group, preferably an alkylene group, containing from 1 to 6 carbon atoms; X represents —S—, $—OCH_2O—$, $—(OCH_2CH_2)_mO—$,

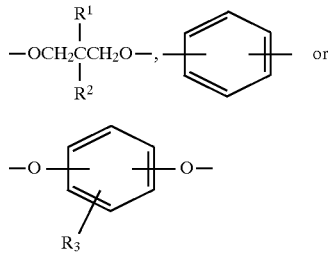

(wherein $R^1$ and $R^2$ each represents a hydrogen atom, a halogen atom, a hydroxyl group, an alkoxyl group, an acyloxyl group or a lower alkyl group and $R^1$ and $R^2$ are the same or different; $R^3$ represents a hydrogen atom, a lower alkyl group, a lower alkoxyl group or a halogen atom; m is an integer of 1 or 2); W represents a branched alkylene group containing from 3 to 10 carbon atoms and n is an integer of from 1 to 10 carbon atoms.

Of the diaryloxyalkanes represented by the general formulae (I) to (III), the following diaryloxy alkanes represented by the following general formulae (IV) to (VII) are especially preferable.

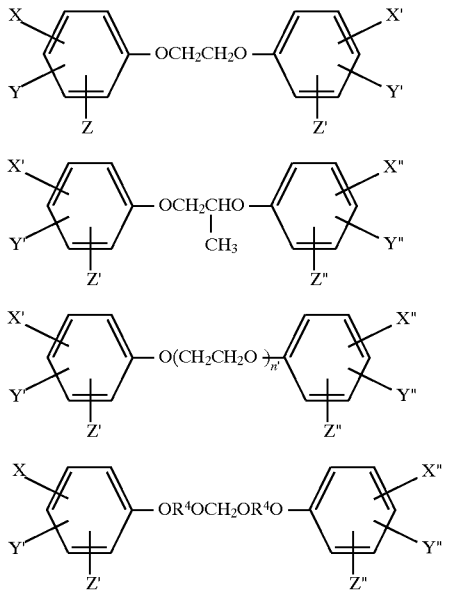

(IV)

(V)

(VI)

(VII)

wherein, X', Y', Z', X", Y" and Z" each represents a hydrogen atom, an alkyl groups, an alkenyl group, a cycloalkyl group, a cycloalkenyl group, a halogen atom, an acyl group, an aryloxyl group, an alkoxyl group, a thioalkoxyl group, an alkoxycarbonyl group, an aryloxyl group, a cyano group, a hydroxyl group, a carboxyl group, an aryl group, an alkylenedioxy group, or an aralkyl group and X',Y', Z', X", Y" and Z" are the same of different; at least one of X, Y and Z represents an alkoxyl group containing 2 or more carbon atoms, an alkoxycarbonyl group containing 3 or more carbon atoms, an aryloxy group, an arloxycarbonyl group, an alkenyl group containing 2 or more carbon atoms, an acyl group containing 4 or more carbon atoms and acyloxyl group containing 2 or more carbon atoms, a fluorine atom, a bormine atom, a carboxyl group, alkylenedioxy group, a cycloalkyl group, and a hydroxyl group, and the remainders thereof represent the same groups as those represented by X', Y' and Z', and X, Y and Z are the same or different; adjacent groups of X, Y, Z, X', Y', Z', X", Y" and Z" may form a 5-membered ring or a 6-membered ring to combine each other; $R^4$ represents a divalent group, preferably an alkylene group, containing from 2 to 6 carbon atoms and n' represents an integer of from 2 to 4.

Of the aryl groups represented by $Ar^1$ in the general formula (I), an aryl group (preferably a phenyl group or naphthyl group) which is substituted by at least one substituent selected from an alkoxyl group containing from 2 to 4 carbon atoms, an alkoxycarbonyl group containing from 3 to 8 carbon atoms, an aryloxyl group containing from 6 to 9 carbon atoms, a phenoxy group substituted with a halogen atom, an aryloxycarbonyl group containing from 7 to 9 carbon atoms, an alkenyl group containing from 2 to 4 carbon atoms, an acyloxyl group containing from 2 to 4 carbon atoms, an alkylenedioxy group containing from 1 to 6 carbon atoms, a fluorine atom, a bromine atom, a carboxyl group, an acyl group containing 4 to 8 carbon atoms, a cyclohexyl group or a hydroxyl group are preferable, especially a phenyl group substituted by a fluorine atom, or an ethoxy group is preferable.

Of the aryl groups represented by $Ar^2$ and $Ar^3$ in the general formula (I) to (III), an aryl group or substituted aryl group which is substituted by an alkyl group containing from 1 to 5 carbon atoms, an alkenyl group containing from 2 to 4 carbon atoms, a cyclohexyl group, a cyclohexenyl group, a fluorine atom, a chlorine atom, an acyl group containing from 1 to 7 carbon atoms, an acyloxyl group cntaining from 1 to 7 carbon atoms, an alkoxyl group containing 1 to 7 carbon atoms, a thioalkoxyl group containing from 1 to 4 carbon atoms, an alkoxyl carbonyl group containing from 2 to 8, an aryloxyl group containing from 6 to 9 carbon atoms, an aryloxycarbonyl group containing from 7 to 9 carbon atoms, a halogen-substituted phenoxy group, a cyano group, a hydroxy group, a carboxy group, an aryl group containing from 6 to 10 carbon atoms, an alkylenedioxy group containing from 1 to 6 carbon atoms or an aralkyl group containing from 7 to 9 carbon atoms are preferable. As aryl group of substituted or unsubstituted aryl group, a phenyl group and a naphthyl group are preferable. Especially, a phenyl group, a naphthyl group, a halogen-substituted phenyl group, a halogen substituted naphthyl group, and a phenyl or naphthyl group which is substituted by an alkyl group containing from 1 to 4 carbon atoms, an alkoxy group containing from 1 to 4 carbon atoms, an acyl group containing from 2 to 4 carbon atoms are most preferable.

The diaryloxyalkane derivatives described above are compounds that have relatively low melting points and exhibit a sharp transition from a solid to liquid state. Among the diaryloxyalkane derivatives shown above, those having melting points in the range of 40° to 180° C. are preferred, and those having melting points between 50° and 150° C. are particularly preferred.

Thermal recording compositions containing diaryloxyalkane derivatives in accordance with the present invention exhibit satisfactorily high color density and sensitivity, show reduced fog and minimal drop in color sensitivity during storage, and produce an adequately fast (stable) color image.

The thermal recording materials containing diaryloxyalkane derivatives represented by the general formulae (VI) and (VII) exhibit a small temperature difference between a temperature that color-forming begins and a temperature that a highest color density is obtained, and an extraordinarily higher sensitivity, i.e., no color change is seemingly observed at about 70° C. and at 85° C. a nearly highest color density is obtained. The fact also teaches that the recording material is effective for a storage for long period under higher temperature. Further, the diaryloxyalkane derivatives represented by the general formulae (VI) and (VII) have an advantage that period for preparing a coating liquid containing the diarylalkane derivatives is extraordinarily shortened, because fine dispersion is liable to be proceeded, in a case of dispersion containing the diarylalkane derivatives.

Specific examples of the diaryloxyalkane derivatives in accordance with the present invention are listed below, to which the scope of the present invention is by no means limited.

1) 1,3-bisphenoxy-2-benzyloxypropane;
2) bis-(2-p-tolyloxyethyl)ether;
3) bis-(β-3,5-dimethylphenoxyethyl)ether;
4) bis-(β-4-benzyloxycarbonylphenoxyethyl)ether;
5) bis-(2-β-naphthyloxyethyl)ether;
6) 1,2-bis{2-(p-tolyloxy)ethoxy}ethane;
7) 1,2-bis{2-(3,5-dimethylphenoxy)ethoxy}ethane;

8) 1,2-bis{2-β-naphthyloxyethoxy}ethane;
9) bis{2-p-tolyloxyethoxy}methane;
10) bis{2-(2,4,6-trimethylphenoxy)ethoxy}methane;
11) bis{2-β-naphthyloxyethoxy}methane;
12) bisphenoxymethylsulfide;
13) bis(2-phenoxyethyl)sulfide;
14) 1,3-bis(phenoxymethyl)benzene;
15) 1,2-bis(phenoxymethyl)benzene;
16) 1-p-tolyloxy-2-p-t-butylphenoxypropane;
17) 1-(3,4-methylenedioxyphenoxy)-2-phenoxyethane;
18) 1-p-isopropylphenoxy-2-p-tolyloxypropane;
19) 1-p-chlorophenoxy-2-p-tolyloxypropane;
20) 1-o-xylenoxy-2-p-tolyloxypropane
21) 3-p-tolyloxy-1-(3,4-dimethylphenoxy)-2-methylpropane;
22) 1-p-tolyloxy-3-phenoxy-2,2-dimethylpropane;
23) 1-phenoxy-2-p-tolyloxypropane
24) 1-p-tolyloxy-2-p-isopropylphenoxypropane
25) 1-p-cyclohexylphenoxy-2-p-cyclohexylphenoxypropane
26) 1-phenoxy-2-bromophenoxyethane
27) 1-phenoxy-2-fluorophenoxyethane
28) 1-fluorophenoxy-2-chlorophenoxyethane
29) 1-phenoxy-2-ethoxyphenoxyethane
30) 1-fluorophenoxy-2-methoxytolyloxyethane
31) 1-methylphenoxy-2-fluorophenoxyethane
32) 1-methylphenoxy-2-fluorotolyloxyethane
33) 1-tolyloxy-2-chloroacetylphenoxyethane
34) 1-phenoxy-2-benzylphenoxypropane
35) 1-phenoxy -2-butoxycarbonylphenoxypropane
36) 1-fluorophenoxy-2-ethoxycarbonylphenoxypropane
37) 1-o-tolyloxy-2-p-ethoxyphenoxyethane
38) 1-p-tolyloxy-2-p-fluorophenoxyethane
39) bis(β-p-methoxyphenoxyethyl)ether
40) bis(β-p-ethoxyphenoxyethyl)ether
41) 1-phenoxy-2-naphthyl(2)oxypropane
42) 1-naphthyl(2)oxy-2-phenoxypropane
43) 1-naphthyl(2)oxy-2-p-methoxyphenoxypropane
44) bis(β-p-ethoxyphenoxyethoxy)methane
45) bis(β-naphthyl(2)oxy-ethoxy)methane
46) bis(β-p-acetylphenoxyethyl)ether
47) 1,3-bis(β-phenoxyethoxy)benzene
48) 2,2-bis{p-(β-phenoxyethoxy)phenyl}propane
49) tetraethyleneglycol-bis-p-biphenylether
50) 1-phenoxy-2-(3-t-butyl-4-hydroxyphenoxy)ethane
51) 1-o-chlorophenoxy-2-p-benzyloxyphenoxyethane
52) 1-phenoxy-2-p-phenoxyphenoxyethane
53) 1-phenoy-2-(4-p-chlorophenoxyphenoxy)ethane
54) 1-m-tolyoxy-2-p-phenoxycarbonylphenoxyethane
55) 1-p-biphenyloxy-2-(2-o-allylphenoxyethoxy)ethane
56) 1-phenoxy-2-p-acetyloxyphenoxyethane
57) 1-phenoxy-2-{3,4-(2,2-propylenedioxy)phenoxy}ethane
58) 1-phenoxy-2-{3,4-(1,1-cyclohexylidenedioxy)phenoxy}ethane
59) 1-phenoxy-2-p-benzylphenoxyethane
60) bis(2-p-acetoxyphenoxyethyl)ether
61) bis(2-p-benzyloxyphenoxyethoxy)methane
62) bis(2-p-methylthiophenoxyethyl)ether
63) bis(2-p-phenoxyphenoxyethyl)ether
64) bis(2-p-cyanophenoxyethyl)ether
65) bis(2-p-biphenyloxyethoxy)methane
66) bis(2-p-cumylphenoxyethyl)ether
67) bis[2-{3,4-(2,2-propylenedioxy)phenoxy}ethyl]ether On process for preparing the diaryloxyalkane derivatives of the present invntioni is performing the reaction represented by the folowing reacion scheme:

A sulfonic acid ester of the formula $$ArOQOSO_2R^5$$

or a halide represented by the formula ArOQ—Hal is reacted with an aromatic alcohol of the formula $$Ar'OH$$

so as to prepare an diaryloxyalkane of the formula:

$$ArOQO—Ar'$$

In the formulae shown above, Ar and Ar' each represents an aryl group, Q represents an alkylene group which may contain at least one hetero atom in the alkylene chain, and Hal represents a halogen atom, and $R^5$ represents an alkyl group or an aryl group, preferably a phenyl group or a tolyl group.

The reaction shown above may be carried out under heating at a temperature between about 50° C. and 150° C. It is also optional to use a base such as a sodium compound, a potassium compound or a calcium compound, or use a solvent such as water, alcohol, hydrocarbon halide, aromatic compound or a polar solvent.

The sulfonic acid ester of aryloxyalkanol used as a starting material for the synthesis of the diaryloxyalkane derivative may be obtained by reacting a sulfonyl chloride compound and an aryloxyalkanol in the presence of a base (either organic or inorganic).

According to another method for the synthesis of the diaryloxyalkane derivative, a sulfonic acid ester of a diol, such as toluenesulfonate ester, is reacted with a phenol, or a corresponding dihalide such as dibromide or chlorobromide may be reacted with a phenol. A base may be used as an effective reaction catalyst.

Reaction solvents are not essential, but if they are used at all, they should be selected from amoung those having boiling points of 50° C. or more such as water, alcohols, dimethylformamide, toluene, sulfolan, ketones and acetonitrile. Suitable bases are those containing sodium or potassium, such as sodium hydroxide, potassium hydroxide, sodium carbonate, and potassium carbonate.

Conventional electron donating colorless dyes such as triarylmethane compounds, diphenylmethane compounds, xanthene compounds, thiazine compounds and spiropyran compounds may be used in the present invention. Examples of such compounds include triarylmethane compounds such as 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindole-3-ylphthalide and 3-(p-dimethylaminophenyl)-3-(2-methylindole-3-yl)phthalide; diphenylmethane compounds such as 4,4'-bis-dimethylaminobenzhydrinbenzyl ether, N-halophenylleucoauramine and N-2,4,5-trichlorophenylleucoauramine; thiazine compounds such as benzoylleucomethylene blue and p-nitrobenzylleucomethylene blue; spiro compounds such as 3-methyl-spirodinaphthopyran, 3-ethyl-spirodinaphthopyran, 3,3'-dichloro-spirodinaphthopyran, 3-benzylspiro-dinaphthopyran, 3-methyl-naphtho-(3-methoxybenzo) spiropyran and 3-propyl-spirodibenzopyran; and xanthene compounds such as Rhodamine-B-anilinolactam, Rhodamine(p-nitroanilino)lactam, Rhodamine B(p-chloroanilino)lactam, and fluoran derivatives. These compounds may be used either alone or in combination.

Fluoran derivatives used in the present invention are those having an arylamino group at the 2-position thereof, a group selected from an aryl group, an aralkyl group, an alkyl group, an alkoxy group, a halogen atom and a hydrogen atom at the 3-position thereof and an alkylamino group having the alkyl moiety of not less than 10 carbon atoms at the 6-position thereof.

More precisely, fluoran derivatives used in the present invention are those represented by the formula (VIII):

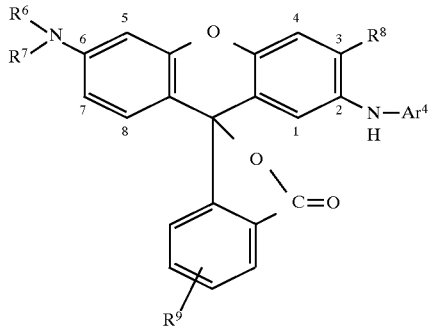

(VIII)

wherein $R^6$ represents an alkyl group having not less than 10 carbon atoms; $R^7$ represents a lower alkyl group having not more than 10 carbon atoms, $R^8$ represents an aryl group having 6 to 9 carbon atoms, an aralkyl group having 7 to 12 carbon atoms, an alkyl group having 1 to 6 carbon atoms, an alkoxyl group having 1 to 6 carbon atoms, a halogen atom or a hydrogen atom; $Ar^4$ represents an aryl group; and $R^9$ represents a hydrogen atom, a chlorine atom or an alkyl group having 1 to 4 carbonatoms, which may be substituted with, e.g., a halogen atom, an alkoxy group, etc.

Examples of fluoran derivatives represented by the above general formula (VIII) include 2-Anilino-3-methyl-6-N-hexadecyl-N-methylaminofluoran
2-Anilino-3-methyl-6-N-octadecyl-N-methylaminofluoran
2-p-Chloroanilino-3-chloro-6-N-dodecyl-N-isoamylaminofluoran
2-Anilino-3-pentadecyl-6-N-decyl-N-ethylaminofluoran
2-Anilino-3-chloro-6-N-octadecyl-N-ethylaminofluoran
2-p-Chloroanilino-3-ethyl-6-N-hexadecyl-N-methylaminofluoran
2-Anilino-3-n-amyl-6-N-butyl-N-octadecylaminofluoran
2-Anilino-3-phenyl-6-N-decyl-N-isoamylaminofluoran
2-Toluidino-3-methyl-6-N-hexadecyl-N-butylaminofluoran
2-o-Toluidino-3-methyl-6-N-ethyl-N-octadecylaminofluoran
2-o-Toluidino-3-methyl-6-N-ethyl-N-dodecylamino-4'-t-butylfluoran.

And other examples of fluoran derivatives used in the present invention include 2-dibenzylamino-6-diethylaminofluoran, 2-anilino-6-dietylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, and 2-anilino-3-chloro-6-N-ethyl-N-isoamylaminofluoran.

Illustrative electron accepting compounds include phenolic compounds, organic acids or metal salts thereof, and oxybenzoic acid esters. Phenolic compounds are particularly preferred, since they exhibit the effects even if they are desired used in small amounts. Details regarding such compounds are described, for example, in Japanese Patent Publication Nos. 14039/1970 and 29830/1976. Specific examples of electron accepting compounds include 4-tertiarybutylphenol, 4-phenylphenol, 4-hydroxydiphenoxide, α-naphthol, β-naphthol, methyl-4-hydroxybenzoate, 2,2'-dihydroxybiphenyl, 2,2-bis(4-hydroxyphenyl)propane (bisphenol A), 4,4'-isopropylidene bis(2-methylphenol), 1,1-bis-(3-chloro-4-hydroxyphenyl) cyclohexane, 1,1-bis-(3-chloro-4-hydroxyphenyl)-2-ethylbutane, 4,4'-secondary isobutylidenediphenol, benzyl-4-hydroxybenzoate, m-chlorobenzyl 4-hydroxybenzoate, β-phenetyl-4-hydroxybenzoate, 4-hydroxy-2',4'-dimethyldiphenylsulfone, 1-t-butyl-4-p-hydroxyphenylsulfonyloxybenzene, 4-N-benzylsulfamoylphenol, p-methylbenzyl-2,4-dihydroxybenzoate, β-phenoxyethyl-2,4-dihydroxybenzoate, benzyl-2,4-dihydroxy-6-methylbenzoate, 2-(4-hydroxyphenyl)-2-(3-isopropyl-4-hydoroxyphenyl)propane, 2-4-hydroxyphenyl-2-3-allyl-4-hydroxyphenylpropane, 2,4-hydroxyphenyl-2-3-methyl-4-hydroxyphenylpropane, α-isopropyl-β-naphthol, methyl-4-hydroxybenzoate, monomethylated dihydroxybiphenyl and zinc rhodanide.

The diaryloxyalkane derivative in accordance with the present invention is used after being dispersed as particles with sizes of 10 μm or less in a dispersion medium in a grinder or disperser, such as a ball mill. Alternatively, the diaryloxyalkane derivative may be charged into a grinder or disperser such as a ball mill where an electron donating colorless dye and/or an electron accepting compound is being dispersed in a dispersion medium.

The electron donating colorless dye and electron accepting compound in accordance with the present invention are used after they have been ground to particle sizes of 10 μm or less, preferably 5 μm or below, more preferably 3 μm or below, in a dispersion medium. Suitable dispersion mediums are aqueous solutions of water-soluble polymers having concentrations of from about 1 to 10%, and dispersions are generally prepared within a ball mill, sand mill, attritor, or colloid mill.

The weight ratio of the electron donating colorless dye to electron accepting compound preferably ranges from 1/10 to 1/1, with the range of from 1/5 to 2/3 being particularly preferred. The diaryloxyalkane derivative is preferably added in amounts ranging from 20 wt % to 300 wt % of the electron accepting compound, with the range of 40 wt % to 150 wt % being particularly preferred.

If the amount of the diaryloxyalkane derivative added is less than 20 wt % of the electron accepting compound, the extent of improvement in color-sensitivity tends to be somewhat low. If more than 300 wt % of the diaryloxyalkane derivative is used, an excessively increased heat capacity of the system will tend to cause an undesirable drop in color sensitivity.

The diaryloxyalkane derivative is preferably used in a coating amount of 0.2 to 7.5 g/m$^2$, the electron accepting compound is preferably used in a coating amount of 0.2 to 5 g/m$^2$ and the electron donating colorless dye is preferably used in a coating amount of 0.1 to 3 g/m$^2$.

A coating solution comprising the electron donating colorless dye, electron accepting compound and diaryloxyalkane derivative may incorporate a variety of additives to satisfy specific optional desired properties. For example, an oil-absorbing substance such as an inorganic pigment may be dispersed in the binder in order to prevent any fouling of the recording head during the recording mode. A fatty acid or metal soap may be added in order to facilitate release of the thermal recording paper from the head. Therefore, in the general case, a thermal recording material is formed by coating a support with a pigment, wax, additive, etc. in addition to the color former and color developer that contribute directly to the formation of a color image.

Specific examples of the pigment include kaolin, fired kaolin, talc, pyrophyllite, diatomaceous earth, calcium carbonate, aluminum hydroxide, magnesium hydroxide, magnesium carbonate, titanium oxide, barium carbonate, petroleum wax, urea-formalin fillers and cellulose fillers. Illustrative waxes include paraffin wax, carnauba wax, microcrystalline wax, polyethylene wax, and higher fatty acid esters.

Exemplary metal soaps include polyvalent metal salts of higher fatty acids such as zinc stearate, aluminum stearate, calcium stearate, and zinc oleate.

The additives shown above are coated onto a support after they are dispersed in a binder. Water-soluble binders are generally used, such as poly(vinyl alcohol), hydroxyethyl cellulose, hydroxypropyl cellulose, ethylene-maleic anhydride copolymer, styrene-maleic anhydride copolymer, isobutylene-maleic anhydride copolymer, polyacrylic acid, acrylamide copolymer, polyacrylic acid amide, starch derivatives, casein, and gelatin. Such binders may be rendered water-proof by addition of gelling agents or crosslinking agents, or emulsions of hydrophilic polymers such as styrene-butadiene rubber latexes and acrylic resin emulsions.

The coating solution thus prepared is most commonly applied to raw paper, preferably neutralized paper, and subsequently finished by calendering. The coating weight generally ranges from 2 to 10 g/m$^2$ on a solids basis. The lower limit of the coating weight is determined by the intended color density while the upper limit is dictated predominantly by economic considerations.

The composition of the present invention is used with advantage in a variety of recording materials and display materials, especially heat transfer systems and thermal recording systems.

The following Examples are provided for further illustration of the present invention, but are not be taken as limiting.

EXAMPLE 1

Two electron donating colorless dyes, 2-anilino-3-chloro-6-diethylaminofluoran (2.5 g) and 2-anilino-3-methyl-6-N-methyl-N-cyclohexylaminofluoran (2.5 g), were dispersed together with 50 g of a 5% aqueous solution of polyvinyl alcohol (degree of saponification: 99%; degree of polymerization: 1,000) by treatment for 24 hours in a ball mill. In a like manner, an electron accepting compound, bisphenol A (10 g), was dispersed together with 100 g of a 5% aqueous solution of polyvinyl alcohol by treatment for 24 hours in a ball mill. Diaryloxyalkane derivative, bis{2-(3,5-bismethylphenoxy) ethyl} ether was also dispersed in an amount of 10 g together with an aqueous solution of 5% polyvinyl alcohol by treatment for 24 hours in a ball mill. The resulting three dispersions were mixed together, and after addition of 20 g of kaolin (Georgia kaolin), the respective components were intimately dispersed. Finally, 5 g of a 50% dispersion of paraffin wax emulsion (Cellosol #428 of Chukyo Yushi K.K.) was added to prepare a coating solution.

The coating solution was applied to a sheet of neutralized paper (basis weight: 50 g/m$^2$) to form a recording layer in a thickness of 6 g/m$^2$ (solids basis). After drying at 60° C. for 1 minute, the web was supercalendered at a linear pressure of 60 kg W/cm to obtain a sample of thermal recording paper.

The recording paper was set on a facsimile and, by application of thermal energy of 35 mJ/mm$^2$, developed a color image. The density of color images developed by thermal application with a facsimile were 1.00.

EXAMPLES 2 AND 3

1) A thermal recording papers were prepared from a formulation that was identical with what was used in the preparation of the recording paper of Example 1, except that the diaryloxyalkane derivative was replaced by 10 g of bis[2-(2,4,6-trimethylphenoxy)ethoxy]methane (Example 2) and 10 g of bisphenoxyethylsulfide (Example 3), respectively.

The thermal recording papers thus obtained were subjected to color images development to measure the densities of color images. The densities of color images for the thermal recording papers of Examples 2 and 3 were 1.02 and 0.99, respectively.

2) Comparative Experiment

A comparative thermal recording paper was prepared from a formulation that was identical with what was used in the preparation of Example 1, except that the diaryloxyalkane derivative was replaced by stearic acid amide. The density of the color image formed on the comparative thermal recording paper by heat application in the same way as in Example 1 was 0.63.

From the above experiments, the recording paper of the present invention shows evidently higher sensitivity than that of the comparative experiment.

EXAMPLES 4 TO 7

Thermal recording papers were prepared from a formulation that was identical with what was used in the preparation of the recording paper of Example 1, except that the electron donating colorless dyes were replaced by 1.0 g of 2-anilino-3-chloro-6-diethylaminofluoron and 4.0 g of 2-anilino-3-methyl-6-N-ethyl-N-isoamylaminofluoran, and the arylalkane derivative was replaced by 1-phenoxy-2-p-fluorophenoxyethane (Example 4), 1-p-tolyloxy-2-p-fluorophenoxyethane (Example 5), 1-o-tolyloxy-2-p-ethoxyphenoxyethane (Example 6), 1-phenoxy-2-naphthyl (2)oxypropane (Example 7) in an amount of 10 g, respectively.

The densities of the color images formed on the thermal recording papers by heat application in the same way as in Example 1 was 1.10 (Example 4), 1.03 (Example 5), 1.05 (Example 6) and 1.00 (Example 7).

EXAMPLES 8 TO 11

1) Thermal recording papers were prepared from a formulation that was identical with what was used in the preparation of the recording paper of Example 1, except that the electron donating colorless dyes were replaced by 2.5 g of 2-anilino-3-chloro-6-diethylaminofluoran and 2.5 g of 2-anilino-3-methyl-6-N-ethyl-N-isoamylaminofluoran, and the diaryloxyalkane derivative was replaced by bis(2-p-methoxyphenoxyethyl)ether (Example 8) bis(2-p-ethoxyphenoxyethoxy)methane (Example 9) bis(2-naphthyl (2)-oxyphenoxyethoxy)methane (Example 10) and bis(2-p-acetylphenoxyethyl)ether (Example 11), in an amount of 10 g, respectively.

The density of the color images formed on the thermal recording papers by heat application in the same way as in Example 1 was 1.03 (Example 8), 1.04 (Example 9), 1.01 (Example 10) and 0.99 (Example 11).

The density at the non-colored parts after the thermal recording papers thus obtained were allowed to stand in an oven heated at 70° C. for 1 hour was 0.1 or less for above each thermal recording paper of Examples 8 to 11.

2) Comparative Experiment

A thermal recording paper was prepared from a formulation that was identical with what was used in the preparation of the recording paper of Examples 8 to 11, except that the diaryloxyalkane derivative was replaced by 10 g of 1,2-bis tolyloxyethane which does not belong to the present invention.

The density of the color images formed on the thermal recording papers by heat application in the same way as in Example 1 was 1.05. The density of the non-colored parts of the thermal recording paper of the comparative Experiment after allowing to stand in an oven heated at 70° C. for 1 hour was 0.32.

It is apparent from the above results that the thermal recording paper of the present invention is superior to the comparative thermal recording paper.

EXAMPLE 12

Electron donating colorless dyes, 2-anilino-3-chloro-6-diethylaminofluoran (2.5 g), 2-anilino-3-methyl-6-N-ethyl-N-isoamylaminofluoran (2.5 g) and 1-o-tolyloxy-2-p-ethoxyphenoxyethane (5.0 g) were dispersed together with 100 g of 5% aqueous solution of polyvinylalcohol denaturated by itaconic acid containing 0.2% of sodium dioctylsulfosuccinate for 24 hours in a ball mill to obtain Dispersion (1). In a like manner, an electron accepting compound, bisphenol A (10 g) and 1-o-tolyloxy-2-p-ethoxyphenoxy ethane (10 g) were dispersed together with 200 g of 5% aqueous solution of polyvinylalcohol for 24 hours in a ball mill to obtain Dispersion (2). The Dispersions (1) and (2) were mixed togehter, and after addition of 20 g of kaolin (Georgia kaolin), the respective components were intimately dispersed. Finally, 5 g of a 50% dispersion of paraffin wax emulsion (Cellosol #428 of Chukyo Yushi K.K.) was added to prepare a coating solution.

The coating solution was applied to a sheet of neutralized paper (basis weight: 50 g/m$^2$) to form a recording layer in a thickness of 5.6 g/m$^2$ (solids basis). After drying at 60° C. for 1 minute, the web was super-calendered at a linear pressure of 68 kg W/cm to obtain a sample of thermal recording paper.

The recording paper was set on a facsimile and by application of thermal energy of 35 mJ/mm$^2$, developed a color image and the densities of color images developed by thermal application with a facsimile were 1.08.

While the invention has been described in detail and with reference to specific embodiments thereof, it will be apparent to one skilled in the art that various changes and modifications can be made therein without departing from the spirit and scope thereof.

What is claimed is:

1. A thermal recording material comprising a support having thereon at least one layer containing an electron donating colorless dye, an electron accepting compound and a diaryloxyalkane derivative represented by the following general formula (I) to (III)

$$Ar^1O(CH_2)_nOAr^2 \quad (I)$$

$$Ar^2O—W—OAr^3 \quad (II)$$

$$Ar^2OR—X—ROAr^3 \quad (III)$$

wherein $Ar^1$ represents an aryl group having at least one substituent selected from the group consisting of an alkoxyl group containing 2 or more carbon atoms, an aryloxycarbonyl group, an alkenyl group containing 2 or more carbon atoms, an acyloxyl group containing 2 or more carbon atoms, a fluorine atom, a carboxyl group, an alkylenedioxy group and a cycloalkyl group; $Ar^2$ and $Ar^3$ each represents a substituted or unsubstituted aryl group the substitutent thereof being selected from the group consisting of an alkyl group, an alkenyl group, a cycloalkyl group, a cycloalkenyl group, a halogen atom, an acyl group, an acyloxyl group, an alkoxyl group, a thioalkoxyl group, an alkoxycarbonyl group, an aryloxycarbonyl group, an aryloxyl group, a cyano group, a hydroxyl group, a carboxyl group, an aryl group, an alkylenedioxy group and an aralkyl group and $Ar^2$ and $Ar^3$ are the same or different; R represents a divalent group containing from 1 to 6 carbon atoms: X represents —S—, —$OCH_2$—,

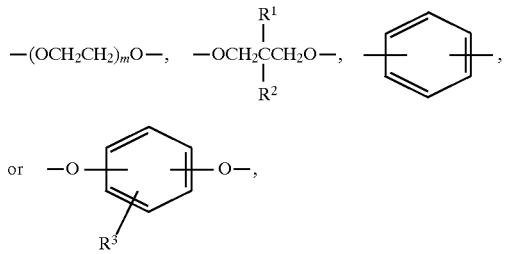

wherein $R^1$ and $R^2$ each represents a hydrogen atom, a halogen atom, a hydroxyl group, an alkoxyl group, an acyloxyl group or a lower alkyl group and $R^1$ and $R^2$ are the same or different; $R^3$ represents a hydrogen atom a lower alkyl group, a lower alkoxyl group or a halogen atom; and m is an integer of 1 or 2; W represents a branched alkylene group, and n is an integer of from 1 to 10; wherein the diaryloxyalkane derivative is a compound represented by formula (V)

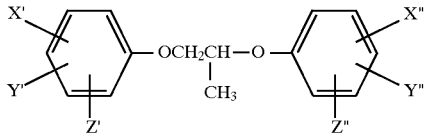

(V)

wherein X', Y', Z', X", Y" and Z" each represents a hydrogen atom, an alkyl group, an alkenyl group, a cycloalkyl group, a cycloalkenyl group, a halogen atom, an acyl group, an acyloxyl group, a thioalkoxyl group, an alkoxycarbonyl group, an aryloxyl group, a cyano group, a hydroxyl group, a carboxyl group, an aryl group, an alkylene dioxy group, or an aralkyl group and X', Y', Z', X", Y" and Z" are the same or different, or at least two of X', Y', Z', X", Y" and Z" form a 5- or 6-membered ring by a combination of adjacent groups thereof.

2. A thermal recording material according to claim 1, wherein the diaryloxyalkane derivative is represented by general formula (II).

3. A thermal recording material according to claim 1, wherein the diaryloxyalkane derivative is represented by general formula (III).

4. A thermal recording material comprising a support having thereon at least one layer containing an electron donating colorless dye, an electron accepting compound and a diaryloxyalkane derivative represented by the following general formula (I) to (III)

$$Ar^1O(CH_2)_nOAr^2 \quad (I)$$

$$Ar^2O—W—OAr^3 \quad (II)$$

$$Ar^2OR—X—ROAr^3 \quad (III)$$

wherein $Ar^1$ represents an aryl group having at least one substituent selected from the group consisting of an alkoxyl group containing 2 or more carbon atoms, an aryloxycarbonyl group, an alkenyl group containing 2 or more carbon atoms, an acyloxyl group containing 2 or more carbon atoms, a fluorine atom, a carboxyl group, an alkylenedioxy group and a cycloalkyl group; $Ar^2$ and $Ar^3$ each represents a substituted or unsubstituted aryl group the substitutent thereof being selected from the group consisting of an alkyl group, an alkenyl group, a cycloalkyl group, a cycloalkenyl group, a halogen atom, an acyl group, an acyloxyl group, an alkoxyl group, a thioalkoxyl group, an alkoxycarbonyl group, an aryloxycarbonyl group, an aryloxyl group, a cyano group, a hydroxyl group, a carboxyl group, an aryl group, an alkylenedioxy group and an aralkyl group and $Ar^2$ and $Ar^3$ are the same or different; R represents a divalent group containing from 1 to 6 carbon atoms; X represents —S—, —$OCH_2$—,

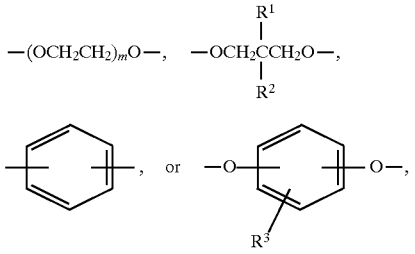

wherein $R^1$ and $R^2$ each represents a hydrogen atom, a halogen atom, a hydroxyl group, an alkoxyl group, an acyloxyl group or a lower alkyl group and $R^1$ and $R^2$ are the same or different; $R^3$ represents a hydrogen atom, a lower alkyl group, a lower alkoxyl group or a halogen atom; and m is an integer of 1 or 2, W represents a branched alkylene group, and n is an integer of from 1 to 10; wherein the diaryloxyalkane derivative is a compound represented by formula (VI)

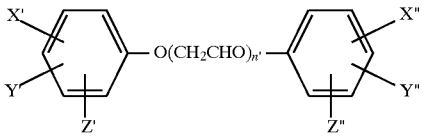

(VI)

wherein X', Y', Z', X", Y" and Z" each represents a hydrogen atom, an alkyl group, an alkenyl group, a cycloalkyl group, a cycloalkenyl group, a halogen atom, an acyl group, an acyloxyl group, a thioalkoxyl group, an alkoxycarbonyl group, an aryloxyl group, a cyano group, a hydroxyl group, a carboxyl group, an aryl group, an alkylene dioxy group, or an aralkyl group and X', Y', Z', X", Y" and Z" are the same or different, or at least two of X', Y', Z', X", Y" and Z" form a 5- or 6-membered ring by a combination of adjacent groups thereof, and n' is an integer of from 2 to 4.

5. A thermal recording material comprising a support having thereon at least one layer containing an electron donating colorless dye, an electron accepting compound and a diaryloxyalkane derivative represented by the following general formula (I) to (III)

$$Ar^1O(CH_2)_nOAr^2 \quad (I)$$

$$Ar^2O—W—OAr^3 \quad (II)$$

$$Ar^2OR—X—ROAr^3 \quad (III)$$

wherein $Ar^1$ represents an aryl group having at least one substituent selected from the group consisting of an alkoxyl group containing 2 or more carbon atoms an aryloxycarbonyl group, an alkenyl group containing 2 or more carbon atoms, an acyloxyl group containing 2 or more carbon atoms, a fluorine atom, a carboxyl group, an alkylenedioxy group and a cycloalkyl group; $Ar^2$ and $Ar^3$ each represents a substituted or unsubstituted aryl group the substitutent thereof being selected from the group consisting of an alkyl group, an alkenyl group, a cycloalkyl group, a cycloalkenyl group, a halogen atom, an acyl group, an acyloxyl group, an alkoxyl group, a thioalkoxyl group, an alkoxycarbonyl group, an aryloxycarbonyl group, an aryloxyl group, a cyano group, a hydroxyl group, a carboxyl group, an aryl group, an alkylenedioxy group and an aralkyl group and $Ar^2$ and $Ar^3$ are the same or different; R represents a divalent group containing from 1 to 6 carbon atoms; X represents —S—, —$OCH_2$—,

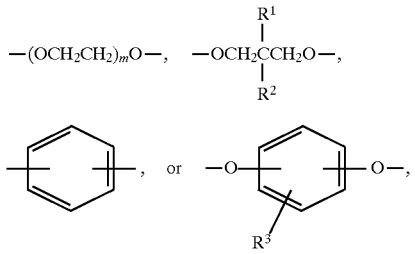

wherein $R^1$ and $R^2$ each represents a hydrogen atom, a halogen atom, a hydroxyl group, an alkoxyl group, an acyloxyl group or a lower alkyl group and $R^1$ and $R^2$ are the same or different; $R^3$ represents a hydrogen atom, a lower alkyl group, a lower alkoxyl group or a halogen atom; and m is an integer of 1 or 2; W represents a branched alkylene group, and n is an integer of from 1 to 10; wherein the diaryloxyalkane derivative is a compound represented by formula (VII)

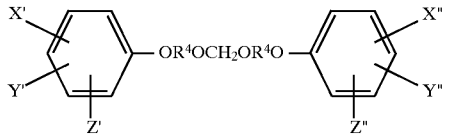

(VII)

X', Y', Z', X", Y" and Z" each represents a hydrogen atom, an alkyl group, an alkenyl group, a cycloalkyl group, a cycloalkenyl group, a halogen atom, an acyl group, an acyloxyl group, a thioalkoxyl group, an alkoxycarbonyl group, an aryloxyl group, a cyano group, a hydroxyl group, a carboxyl group, an aryl group, an alkylene dioxy group, or an aralkyl group and X', Y', Z', X", Y" and Z" are the same or different, or at least two of X', Y', Z', X", Y" and Z" form a 5- or 6-membered ring by a combination of a adjacent groups thereof; and $R^4$ represents a divalent group containing from 2 to 6 carbon atoms.

* * * * *